US008789701B2

(12) United States Patent
Hohlbein

(10) Patent No.: US 8,789,701 B2
(45) Date of Patent: Jul. 29, 2014

(54) ORAL CARE KIT

(75) Inventor: Douglas J. Hohlbein, Hopewell, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/007,582

(22) PCT Filed: Apr. 15, 2011

(86) PCT No.: PCT/US2011/032649
§ 371 (c)(1),
(2), (4) Date: Sep. 25, 2013

(87) PCT Pub. No.: WO2012/141716
PCT Pub. Date: Oct. 18, 2012

(65) Prior Publication Data

US 2014/0014543 A1 Jan. 16, 2014

(51) Int. Cl.
*B65D 83/00* (2006.01)

(52) U.S. Cl.
USPC ..... 206/572; 206/63.5; 206/822; 229/87.05

(58) Field of Classification Search
USPC ..... 206/223, 570, 572, 63.5, 368, 369, 361, 206/362, 362.1, 362.2, 822; 229/87.05
See application file for complete search history.

(56) References Cited

U.S. PATENT DOCUMENTS 1,943,538 A * 1/1934 Kahn ..... 229/87.05
1,955,175 A * 4/1934 Crowther ..... 63/5.1
2,158,747 A * 5/1939 Doros ..... 30/294
2,223,952 A 12/1940 Darmody
2,527,931 A * 10/1950 Iskoe ..... 15/167.1
3,451,539 A * 6/1969 Wysocki ..... 426/122
4,030,845 A 6/1977 Deckert
4,124,316 A 11/1978 O'Rourke
4,149,815 A 4/1979 Kawam
4,176,980 A 12/1979 O'Neal et al.
4,221,492 A 9/1980 Boscardin et al.
4,332,497 A 6/1982 Rodriguez
4,486,109 A 12/1984 Rosofsky
4,521,128 A 6/1985 O'Neal
4,530,129 A * 7/1985 Labick et al. ..... 15/184

(Continued)

FOREIGN PATENT DOCUMENTS

EP 1 639 913 3/2006
FR 2 843 287 2/2004
WO WO 95/01921 1/1995

OTHER PUBLICATIONS

International Search Report and the Written Opinion of the International Searching Authority issued in International Application PCT/US2011/032649 mailed Dec. 19, 2011.

(Continued)

*Primary Examiner* — Jacob K Ackun
(74) *Attorney, Agent, or Firm* — Ryan M. Flandro

(57) ABSTRACT

An oral care kit includes a sachet having a ring shaped reservoir for an oral care material configured around a central opening. The sachet has a first weakened portion for forming a dispensing nozzle. The oral care kit also includes an oral care implement sized so that a portion of the oral care implement fits through the central opening. The oral care implement is configured to be used to tear the first weakened portion of the reservoir.

10 Claims, 15 Drawing Sheets

(56) References Cited

U.S. PATENT DOCUMENTS

| | | | | | |
|---|---|---|---|---|---|
| 4,582,075 | A | | 4/1986 | O'Neal et al. | |
| 4,588,089 | A | | 5/1986 | Yanz et al. | |
| 4,705,680 | A | | 11/1987 | Vellekoop | |
| 4,728,508 | A | | 3/1988 | Hayes et al. | |
| 4,770,324 | A | | 9/1988 | Parnell et al. | |
| 4,844,641 | A | | 7/1989 | Grosfilley et al. | |
| 4,865,481 | A | | 9/1989 | Scales | |
| 4,880,111 | A | | 11/1989 | Bagwell et al. | |
| 4,902,154 | A | | 2/1990 | Valenza | |
| 4,934,523 | A | * | 6/1990 | Strom | 206/63.5 |
| 5,041,279 | A | | 8/1991 | Brett et al. | |
| 5,096,698 | A | | 3/1992 | Mitchell et al. | |
| 5,338,124 | A | | 8/1994 | Spicer et al. | |
| 5,366,310 | A | | 11/1994 | Flors | |
| 5,476,333 | A | | 12/1995 | Matthews | |
| 5,476,334 | A | | 12/1995 | Tello-Vallarino | |
| 5,584,593 | A | | 12/1996 | Lafortune | |
| 5,599,126 | A | | 2/1997 | Hough | |
| 5,911,319 | A | * | 6/1999 | Porcelli et al. | 206/63.5 |
| 5,915,868 | A | | 6/1999 | Frazell | |
| 5,918,995 | A | | 7/1999 | Puurunen | |
| 5,921,692 | A | | 7/1999 | Weber | |
| 5,980,145 | A | | 11/1999 | Griffith | |
| 5,989,205 | A | * | 11/1999 | Pond et al. | 604/3 |
| 6,056,469 | A | | 5/2000 | Algorri | |
| 6,062,233 | A | * | 5/2000 | Williams | 132/309 |
| 6,238,118 | B1 | | 5/2001 | Tryon | |
| 6,397,860 | B1 | * | 6/2002 | Hill, II | 132/309 |
| 6,599,048 | B2 | | 7/2003 | Kuo | |
| 6,672,783 | B1 | | 1/2004 | Licata et al. | |
| 6,679,642 | B1 | | 1/2004 | Dillingham et al. | |
| 6,715,952 | B1 | | 4/2004 | Aiken et al. | |
| 6,817,803 | B1 | | 11/2004 | Ong et al. | |
| 7,048,120 | B2 | * | 5/2006 | Pond | 206/366 |
| 7,182,542 | B2 | | 2/2007 | Hohlbein | |
| 7,237,974 | B2 | | 7/2007 | Pfenninger et al. | |
| 7,270,239 | B1 | | 9/2007 | Ross | |
| 7,273,327 | B2 | | 9/2007 | Hohlbein et al. | |
| 7,293,928 | B2 | | 11/2007 | Lane | |
| 7,458,464 | B1 | * | 12/2008 | Kutsch et al. | 206/570 |
| 7,478,959 | B2 | | 1/2009 | Hohlbein | |
| 7,575,387 | B2 | | 8/2009 | Atkin | |
| 7,866,477 | B2 | * | 1/2011 | Sturm et al. | 206/570 |
| 8,181,786 | B1 | * | 5/2012 | Alas | 206/570 |
| 8,550,093 | B2 | * | 10/2013 | Saint-Girons et al. | 131/347 |
| 2003/0012594 | A1 | | 1/2003 | Andersen | |
| 2003/0086743 | A1 | | 5/2003 | Gruenbacher | |
| 2003/0146117 | A1 | | 8/2003 | Raia | |
| 2007/0292198 | A1 | | 12/2007 | Frazell | |
| 2008/0120798 | A1 | | 5/2008 | Sorrentino | |
| 2009/0049632 | A1 | | 2/2009 | Holowecky | |
| 2009/0084690 | A1 | * | 4/2009 | Bressler et al. | 206/63.5 |
| 2009/0123217 | A1 | | 5/2009 | Ross | |
| 2010/0018881 | A1 | * | 1/2010 | Suchan et al. | 206/223 |
| 2010/0125097 | A1 | * | 5/2010 | Soll et al. | 514/407 |
| 2010/0200435 | A1 | * | 8/2010 | Baus | 206/63.5 |
| 2011/0041272 | A1 | | 2/2011 | Prencipe et al. | |
| 2014/0021070 | A1 | * | 1/2014 | Le et al. | 206/63.5 |

OTHER PUBLICATIONS

International Search Report and the Written Opinion of the International Searching Authority issued in International Application PCT/US2010/061883 mailed May 20, 2011.

Written Opinion of the International Preliminary Examining Authority issued in International Application PCT/US2010/061883 mailed Dec. 18, 2012.

* cited by examiner

ORAL CARE KIT

CROSS-REFERENCE TO RELATED PATENT APPLICATIONS

The present application is a U.S. national stage application under 35 U.S.C. 371 of PCT Application No. PCT/US2011/032649, filed Apr. 15, 2011, the entirety of which is incorporated herein by reference.

FIELD OF THE INVENTION

The present invention relates generally to toothbrushes, and, more particularly, to a kit having a toothbrush and an oral care dispenser containing an oral care material.

BACKGROUND OF THE INVENTION

The advantages of good dental hygiene are well known. Often, however, toothbrushes are forgotten when one is traveling or away from home. Hotels, health care facilities, nursing homes, hospitals, daycare facilities, schools, airlines, etc. can use single use disposable or limited multiple use toothbrushes that may be economically supplied to and discarded by individuals without a toothbrush and/or a water supply. Such toothbrushes could be used in vending machines, or distributed in large quantities for simple, portable use from anywhere.

Various types of disposable, limited use, or portable toothbrushes are known in the art. An improved portable toothbrush is desired.

BRIEF SUMMARY OF THE INVENTION

In some embodiments, an oral care kit comprises a sachet having a ring shaped reservoir for an oral care material configured around a central opening. The sachet has a first weakened portion for forming a dispensing nozzle. An oral care implement is sized so that a portion of the oral care implement fits through the central opening. The oral care implement is configured to be used to tear the first weakened portion of the reservoir.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings which are given by way of illustration only, and thus are not limitative of the present invention, and wherein.

DETAILED DESCRIPTION OF THE INVENTION

Figure 1:
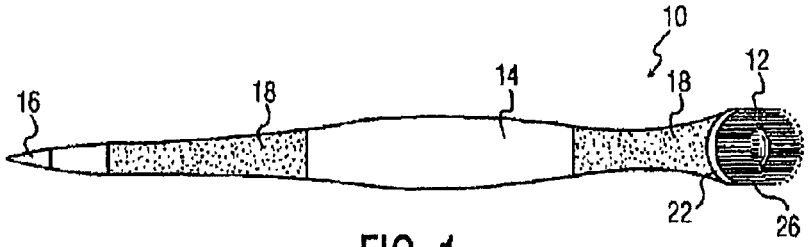
FIG. 1 is a front elevational view of an oral care toothbrush with a toothpick connected thereto.

The following description of the preferred embodiment(s) is merely exemplary in nature and is in no way intended to limit the invention, its application, or uses.

The following detailed description refers to the accompanying drawings. The same reference numbers in different figures identify the same or similar elements.

FIGS. 1-4 illustrate an oral care toothbrush 10 that includes a head 12 and a handle 14. The head 12 may be a refill head and thus be removably connected to the handle 14, or the head 12 may be permanently connected to the handle 14.

The majority of the handle 14 and a portion of the head 12 may be molded from a variety of rigid materials, including plastics, resins, etc., such as, for example, polypropylene. At an end portion of the handle 14, opposite the end to which the head 12 is attached, there is attached an accessory 16. The accessory 16 may be a toothpick in some embodiment of the invention. The toothpick 16 is formed of a resilient and soft thermoplastic elastomer. The accessory 16 may be a refill and thus be removably connected to the handle 14. The accessory 16 may be permanently connected to the handle 14. The accessory 16 provides a mechanism for spot cleaning between teeth. Forming the accessory 16 of a soft elastomer provides more comfortable interproximal cleaning between teeth. The accessory 16 could, however, be made of a stiff rigid material similar to the main portion of handle 14, or it could simply be a rubber or elastomeric pick adhered or otherwise mounted to the end of handle 14.

Portions 18 of the handle 14 may also be formed of a resilient and soft thermoplastic elastomer. The thermoplastic elastomer which forms the accessory 16 and the handle portion 18 may be a thermoplastic vulcanate (TPV) consisting of a mixture of polypropylene and EPDM (ethylene propylene diene monomers) which is available as SANTOPRENE (brand), described in U.S. Pat. No. 5,393,796, or VYRAM (brand), another TPV consisting of a mixture of polypropylene and natural rubber. Both SANTOPRENE and VYRAM (brands) are elastomers marketed by Advanced Elastomer Systems. Other suitable elastomers include KRATON, a brand of styrene block copolymer (SBC) marketed by Shell, and DYNAFLEX G 2706 (brand), a thermoplastic elastomer marketed by GLS Corporation and which is made with KRATON (brand) polymer.

The handle 14 may further include dimples, bumps, or ridges protruding from portions of its surface, and providing a decorative appearance to the handle 14 and enhanced gripping of the handle 14 during use of the toothbrush 10. The dimples may be formed from the same material as soft elastomer portions 18 of the handle 14 or from the same material as the majority of the handle 14 (e.g., a rigid material such as polypropylene). All or part of the handle 14 could be made of any suitable material, such as plastic, wood, metal or various natural materials which are biodegradable. Preferably the handle 14 is made of a generally flat or oval shape rather than cylindrical in its gripping portion which would be between the spaced elastomer portions 18 to facilitate the gripping of the handle.

Figure 4:
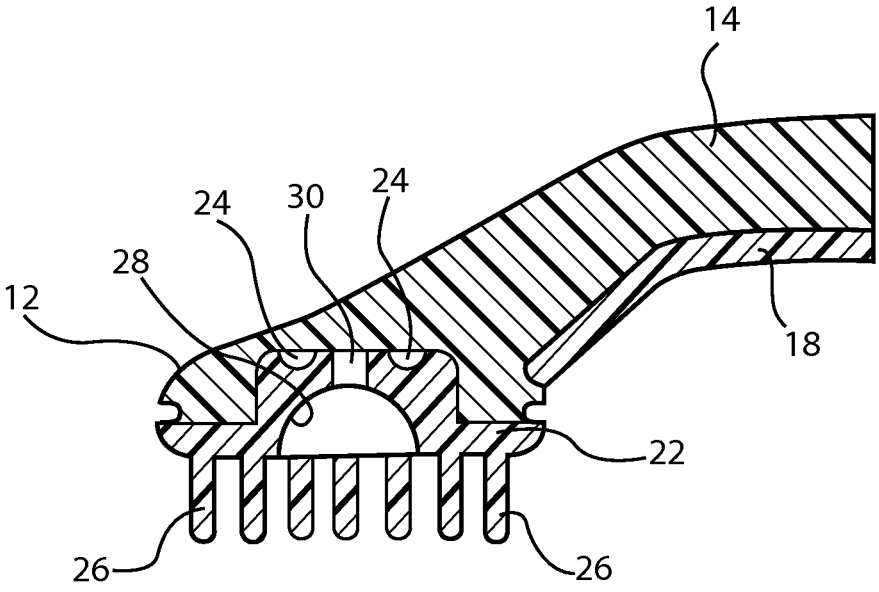
FIG. 4 is a fragmental, cross-sectional view of the head of an oral care toothbrush.

As shown in FIG. 4 another portion of the head 12, defining a bristle or cleaning element block 22 of head 12, may also be formed of a resilient and soft thermoplastic elastomer, such as the thermoplastic elastomer used to form the handle portions 18. The cleaning block 22 may optionally include one or more depressions 24 provided in a surface thereof with an opening 30 therein. The cleaning block 22 further includes a multitude of cleaning elements which could be conventional filament, preferably nylon, or elastomeric bristles or fingers 26 extending integrally outwardly from the outer surface of the head 12. In the illustrated embodiment as best shown in FIG. 4, all of the cleaning elements 26 extend outwardly from the outer surface of the cleaning block 22 the same distance so as to create a generally flat surface. Alternatively, however, some elements 26 may be shorter or longer than other elements 26. The variable length of the cleaning elements 26 is illustrated by the dotted out tips 26*a* in FIG. 14, with only body portions 26*b* of the cleaning elements 26 shown in solid lines for purposes of clarity and to focus on the variable nature of such elements.

The term "cleaning elements" as used herein is intended to include massage elements arranged in a circular, elliptical, or oval cross-section shape or any type of desired shape, including straight portions or sinusoidal portions. It is to be understood that the specific illustration of the cleaning elements is merely for exemplary purposes. The features herein can, however, be practiced with various combinations of the same or different configurations (such as stapled or in-mold tufting (IMT) bristle technology and/or with the same or different bristle materials (such as nylon bristles, spiral bristles, rubber bristles, etc.). Similarly, while FIGS. 1-4 illustrate the cleaning elements 26 to be generally perpendicular to the outer surface of head 12, some or all of the cleaning elements 26 may be angled at various angles with respect to the outer surface of the head 12. It is thereby possible to select the combination of configurations, materials and orientations to achieve specific intended results, such as enhanced cleaning, tooth polishing, breath freshening, tooth whitening and/or massaging of the gums.

In some embodiments, the cleaning elements 26 may be in the form of bristles made from conventional materials, such as nylon, as well as from a combination of materials so as to provide the proper stiffness in an economical manner. For example, the cleaning elements 26 could be made of a flexible resilient material, such as TPE and a lesser expensive material such as LLDPE (linear low density polyethylene) or EVA (ethylene vinyl acetate) or a TPE. The cleaning elements 26 could be made of a blend of TPE and either LLDPE, EVA, or polypropylene. Preferably, the two materials are combined to provide a stiffness of less than 600 MPa. The blend of materials would give the properties of conventional nylon bristles, while offering reduced costs. For example, there would be lower manufacturing costs by injection molding instead of conventional bristle tufting. Alternatively the resilient material could be a single material, such as hard TPE (i.e. Shore A 80 hardness), straight LLDPE or straight EVA.

The cleaning elements 26 may be of any desired shape. For example, the cleaning elements 26 could be of cylindrical shape having a uniform diameter throughout their length. Alternatively, the cleaning elements 26 could taper from the root of each cleaning element where it extends from the head 22 to its outer cleaning end. In some embodiments, to provide a small lightweight toothbrush, the dimensions of the various components of the toothbrush 10 are preferably small. Thus, for example, each cleaning element 26 may extend outwardly from the outer surface of the cleaning block 12 a distance no greater than 10 mm and preferably no greater than 8 mm and most preferably no greater than 6 mm. Where tapered cleaning elements are used the root diameter should be no greater than 1.5 mm, preferably no greater than 1 mm, most preferably no greater than 0.7 mm or no greater than 0.5 mm or no greater than 0.3 mm. The diameter could then decrease in size to no greater than 0.2 mm at a distance of no greater than 6 mm from the base of the cleaning element. The taper relationship of diameter at a distance location above the root diameter could be a range of no greater than 1 mm at a distance of no greater than 10 mm, preferably no greater than 0.6 mm at a distance of no greater than 8 mm, most preferably no greater than 0.2 mm at a distance of no greater than 6 mm. Preferably, the length of the entire toothbrush 10 is no greater than 5 inches, preferably no greater than 4 inches, and more preferably no greater than 3.75 or 3 or 2.50 inches, and may be in the range of 2 to 4 inches.

In some embodiments, the cleaning elements 26 may vary in diameter at their proximate ends, so that the cleaning elements 26 in different areas of the field have different thicknesses and rigidity or axial stiffness as measured from the longitudinal axis of the bristle. In such a construction, inner or central region bristles 26*b* are stiffer than the outer or peripheral region cleaning elements 26*c*. The cleaning elements 26 of the carrier 80 may taper towards their distal ends.

The variable stiffness arrangement of the field of cleaning elements 26 forms a structure for incremental radial flow control of oral care solution/material during a brushing operation for efficient cleaning. This feature is particularly useful for low viscosity oral care solutions. Nevertheless, oral care solutions of higher viscosity can be used in the toothbrush 10. The cleaning elements 26 are independently flexible. In this regard, during a brushing operation, the free ends (e.g., tip) of the stiffer cleaning elements 26*b* bend relative to their, respective vertical axis less than the outer cleaning elements 26*c* (e.g., bristles near the periphery). Hence, a portion of the dentifrice stays longer in the central region of the brush head by reduced dynamic bending or action of the stiffer bristles. The sweeping or oscillating motion transfers a portion of the retained liquid to the outer region of the cleaning elements.

While the outer cleaning elements 26*c* are less stiff, the dynamic bending relative to their vertical axis additionally causes the outer bristles to receive a portion of the dentifrice from the central region of the cleaning elements. In this construction, effective cleaning of the tissue surfaces in the mouth may be obtained though the combined use of the variable stiffness bristle field mechanically scrubbing the tissue surfaces and the beneficial effects of applying the oral care material from the dispenser in the oral cavity. In this way, the bristles field provides a limited and controlled flow of the dentifrice or other oral care material to the outer bristles and maintains sufficient flexibility to provide greater user comfort and improved cleaning of the oral tissues.

The head 12 may be angled at a 10° angle with respect to the handle 14, representing a less-angled head than that shown in FIGS. 1-4. An angle ranging from 8° to 12° may assist in improving a user's brushing technique. The block 22 may be made of the same materials as some or all of the bristles 26 and portions of the handle 14. Alternatively, the handle 14 may be made of the same material as the block 22 and/or bristles 26.

Figure 14:
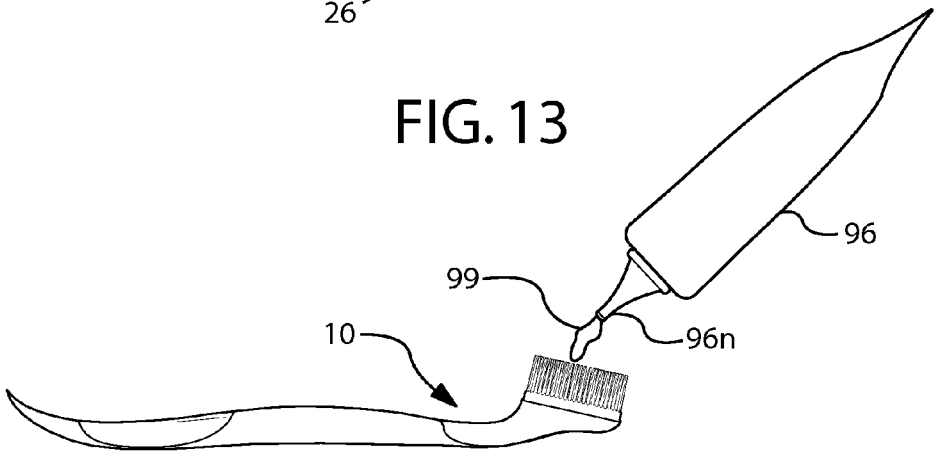
FIG. 14 shows one of the oral care instruments and the dispenser of FIG. 12 in use.

As illustrated in FIGS. 1 and 4 the cleaning elements 26 define a cleaning field in the head 22. The cleaning elements 26 preferably extend outwardly from the cleaning block 22, as shown in FIG. 4. The features herein, however, can also be practiced where the cleaning elements extend either a greater distance or a lesser distance than as shown in FIG. 14.

As stated above, the cleaning block 22 may include one or more optional depressions 24 which are designed to receive and retain an oral care material therein. The one or more depressions 24 can be varied in size so as to accommodate varying quantities of toothpowder, a toothpaste or tooth cleaning gel dentifrice or other oral care material, for delivery to the dentiture as the elements 26 extending from the block 22 are applied thereto, during use, such that the oral care material enhances the cleaning of the dentiture by the cleaning elements. In some embodiments, the toothbrush 10 is manufactured containing a packed toothpowder, toothpaste or tooth cleaning gel dentifrice and used repeatedly by the user refilling the dispenser with toothpowder, toothpaste or tooth cleaning gel dentifrice. In other embodiments, the toothbrush 10 is provided as part of a kit with a separately packaged oral care material, which is manually placed by the user onto the cleaning element 26 or in the depression 24, if present.

In some embodiments, the depression is in the form of a cushioned socket 28. Cushioning socket 28 opening 30, and the material making up bristle block 22 provide a cushioning effect.

The user applies a oral care material onto the bristles 26 of the toothbrush head 12. The oral care material may be a toothpaste, a gel, a mouthwash, a powder, or similar dentifrice or oral hygiene product, or a combination of the same. The materials making up the oral care material preferably are consumable by the user of the toothbrush 10, eliminating the need for water, a sink, or a waste receptacle to expectorate the oral care material.

The oral care material may include an active agent. Non-limiting examples of active agents which can be used include antibacterial agents, whitening agents, anti-sensitivity agents, anti-inflammatory agents, anti-attachment agents, plaque indicator agents, flavorants, sensates, breath freshening agents, gum health agents and colorants. Examples of these agents include metal ion agents (e.g., stannous ion agents, copper ion agents, zinc ion agents, silver ion agents) triclosan; triclosan monophosphate, chlorhexidine, alexidine, hexetidine, sanguinarine, benzalkonium chloride, salicylanilide, domiphen bromide, cetylpyridinium chloride, tetradecylpyridinium chloride, N-tetradecyl-4-ethylpyridinium chloride (TDEPC), octenidine, delmopinol, octapinol, nisin, essential oils, furanones, bacteriocins, flavans, flavinoids, folic acids, vitamins, minerals, hydrogen peroxide, urea peroxide, sodium percarbonate, PVP-H2O2, polymer-bound perxoxides, potassium nitrates, occluding agents, bioactive glass, arginine salts, arginine bicarbonate, bacalin, polyphenols, ethyl pyruvate, guanidinoethyl disulfide, tartar control agents, anti-stain ingredients, phosphate salts, polyvinylphosphonic acid, PVM/MA copolymers; enzymes, glucose oxidase, papain, ficin, ethyl lauroyl arginate, menthol, carvone, and anethole, various flavoring aldehydes, esters, and alcohols, spearmint oils, peppermint oil, wintergreen oil, sassafras oil, clove oil, sage oil, eucalyptus oil, marjoram oil, cinnamon oil, lemon oil, lime oil, grapefruit oil, and/or orange oil.

The active agent may be compatible with toothpaste, or may be unstable and/or reactive with typical toothpaste ingredients. The active agent also may be a tooth cleaning agent to boost the overall efficacy of brushing.

The active agent can be provided in any suitable vehicle, such as in aqueous solution or in the form of gel, paste or powder. The vehicle can have a variety of different visual aesthetics including clear solution or gel or opaque solution or gel. Non-limiting examples of vehicles include water, monohydric alcohols such as ethanol, poly(ethylene oxides) such as polyethylene glycols such as PEG 2M, 5M, 7M, 14M, 23M, 45M, and 90M available from Union Carbide, carboxymethylene polymers such as Carbopol® 934 and 974 available from B.F. Goodrich, and combinations thereof. The selection of a suitable vehicle will be apparent to persons skilled in the art depending on such factors as the properties of the active agent and the desired properties of the medium, such as viscosity.

In use, the user applies the oral care material over cleaning elements 26. The user then may brush their teeth with toothbrush 10. The user may also use the accessory 16 to clean between teeth, either before or after brushing. After the user has used the toothbrush 10, one may, but not necessarily, then easily and economically dispose of the toothbrush 10.

In some embodiments, the entire structure of the toothbrush 10, including the head 12, the handle 14, and the accessory 16, may be molded as one integral structure, using a conventional multi-component injection molding operation typically used in the manufacture of toothbrushes. This enables the toothbrush 10 to be economically and quickly manufactured. Although the toothbrush 10 may have a variety of sizes and dimensions, it is preferred that the toothbrush 10 have a small profile, with the head 12 being small enough to cover one tooth at a time and the handle 14 being thinner than conventional, everyday toothbrush handles. The toothbrush 10 is thus readily portable or space saving.

The toothbrush 10 may provide many benefits, including the cosmetic benefits of brushing one's teeth in a form that can be used when one is away from home, and away from a water supply. The cosmetic benefits achieved by the toothbrush 10 include the cleaning of debris between teeth with the accessory 16, broad tooth surface cleaning with the cleaning elements 26 and the oral care solution, and breath freshening with the oral care solution.

In addition to the cosmetic benefits, the toothbrush 10 may also provide economic benefits in the form of an inexpensive toothbrush that is both quickly and economically manufactured. Toothbrush 10 also provides a mechanism for maintaining oral health, without the need for toothpaste, water, mouth wash, and containers to hold the same. Thus, toothbrush 10 is also very convenient to use.

Furthermore, the toothbrush 10 provides at least one benefit of preventing the spread of waterborne diseases. For example, the toothbrush 10 eliminates the conventional practice of using local water to mix with toothpaste. This feature is useful for military applications where there is a limited source of potable water or a need to conserve water or maintain the oral health of troops, such as in desert fighting environments. In another situation, the toothbrush is useful in outdoor camping environments to prevent disease or sickness from waterborne bacteria.

Although FIGS. 1-4 illustrate a manually-operated, disposable toothbrush, the features herein may also be practiced where the head includes one or more power or electrically operated movable sections carrying cleaning elements. Such movable section may oscillate in a rotational manner or may oscillate linearly in a longitudinal direction with respect to the longitudinal axis of the head or may oscillate linearly in a lateral or transverse direction with respect to the longitudinal axis of the head. The movable section may oscillate in and out in a direction toward and away from the outer surface of the head. The movable section may rock back and forth with respect to the outer surface of the head. The movable section may rotate continuously in the same direction, rather than oscillate. Any suitable drive mechanism may be used for imparting the desired motion to the movable section. Where plural movable sections are used, all of the movable sections may have the same type and direction of movement, or combinations of different movements may be used.

Since the toothbrush 10 is intended to be both small and lightweight, it is preferred that the toothbrush 10 weigh no more than 3 grams, but this is an option, and the toothbrush 10 may have a greater weight. The small size is such that it can be held completely within the palm of an adult user. The head 12 is of a size that it would correspond to the size of an individual tooth or an individual tooth and the interproximal areas. The head 12 could be made of any suitable shape and is preferably of circular, elliptical, oval or tri-lobal shape having a maximum lateral dimension or diameter of no greater than 13 mm, preferably no greater than 12 mm and most preferably no greater than 11 mm. Where the head 12 is of non-circular shape its preferred maximum lateral dimension is 14 mm.

Figure 2:
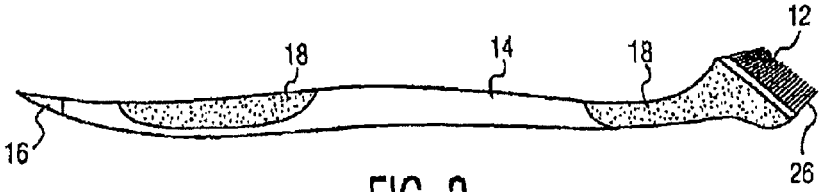
FIG. 2 is a side elevational view of the toothbrush shown in FIG. 1.

As shown in FIG. 2, the head 12 may be at an angle between 0° and 90° to the longitudinal axis of handle 14. The preferred angle is from 20° to 70° and more preferably from 30° to 60°. The cleaning elements could be perpendicular to the outer surface of head 12 or could also be at an angle to the outer surface such as in the range of 60° to 90° or in the range of 75° to 90°.

In one embodiment, the cleaning elements could be hollow, such as hollow bristles, which are capable of absorbing a medicament by capillary action. Such a feature would be particularly useful for children where a medicament or some form of flavor could be dispensed from the hollow cleaning elements. It is also possible to leach antibacterial material from the cleaning elements. In one embodiment where the cleaning elements are used to dispense oral care materials the cleaning elements themselves may be considered as the oral care dispensers without requiring additional dispensers.

Where specific parameters and characteristics have been given for cleaning elements, the features herein could be practiced where other cleaning elements do not include those parameters and characteristics.

Figure 5:
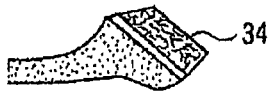
FIGS. 5-6 are side elevational views of other forms of heads for an oral care toothbrush.
Figure 6:
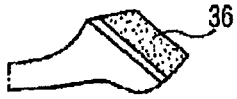

FIGS. 5-6 show other variations wherein the cleaning elements are in the form of a single mass having an irregular outer surface. As shown in FIG. 5 the mass 34 is similar to that of "steel wool" as used in household cleaning or could be part of VELCRO, formations, such as hooks or loops.

FIG. 6 shows a variation where the cleaning element 36 is of a single mass of sponge, foam or cotton which could be used as a swab for oral care material. In some embodiments, the cleaning element 36 provides an absorbent receptacle for the oral care material. The outer surface of the swab could be generally planar or could have surface irregularities. In such embodiments, the cleaning element 36 could be impregnated with the oral care material or could be dipped into oral care material so as to absorb the material and thereby the cleaning element 36 would also function as the oral care dispenser. Such swab type cleaning elements are gentle for children, particularly infants.

In some embodiments, the element 36 is a single piece of melamine foam, a foam-like material comprising a formaldehyde-melamine-sodium bisulfite copolymer. Melamine foam is available from BASF of Ludwigshafen am Rhein, Germany, and is also sold under the name "MR. CLEAN MAGIC ERASER"™ by Procter & Gamble. Melamine foam is an effective abrasive cleaner. The open cell foam is microporous and works like extremely fine sandpaper, getting into tiny grooves and pits in the tooth surface being cleaned. On a larger scale the material feels soft.

Figure 7:
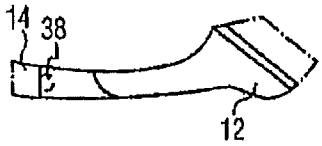
FIG. 7 is a fragmental side elevational view showing a head detachably mounted to the handle for an alternate embodiment.

The features herein could be practiced where the various components of the toothbrush 10 are segmented for manufacturing and assembly purposes. Such segmented components could also be detachably connected together so as to permit the interchangeability of the components thereby providing the possibility for the substitution of different components in the combination. Thus, the head 12 could be detachably connected to the handle 14. FIG. 7, for example, illustrates head 12 to be detachably mounted to handle 14 by a snap fitting 38 which may be of any suitable construction as is known to those of ordinary skill in the art.

The concept of a detachable interconnection may also be used wherein the oral care accessory 16, such as the toothpick, is detachably mounted to the handle 14. Thus, as later described with respect to FIGS. 12 and 13 the toothbrush and its various components could be packaged wherein the same package includes a plurality of toothbrushes and/or a plurality of different components such as heads, dispensers or accessories.

Figure 8:
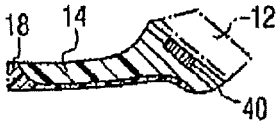
FIG. 8 is a fragmental cross-sectional elevational view showing a vibrating toothbrush head for an alternate embodiment.

FIG. 8 shows a further embodiment wherein a piezoelectric crystal 40 is provided in the handle 14 at the junction with head 12 so as to cause the head 12 to vibrate during use. Alternatively the head 12 could be mounted to a rotatable shaft extending from the handle and having an eccentric weight on the shaft to cause the head to vibrate.

Figure 3:
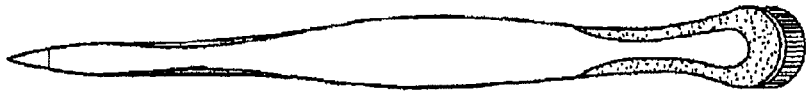
FIG. 3 is a rear elevational view of the toothbrush shown in FIGS. 1-2.
Figure 9:
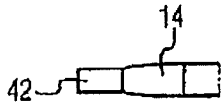
FIGS. 9-10 are fragmental front elevational views partly broken away of portions of a handle for an alternate embodiment.

Although FIGS. 1-3 illustrate an oral care accessory 16 in the form of a toothpick, other types of accessories 42 could be used as schematically shown in FIG. 9. As illustrated therein such accessory 42 would be mounted to the end of the handle 14 similar to the mounting of the toothpick. Such mounting could be detachable or of a permanent nature. Examples of such oral care accessories 16/42 include tongue cleaners, floss holders or an interproximal brush. Similarly, the accessory 16/42 could be of a swab or foam type similar to the cleaning element 36 of FIG. 6 or could be of the single mass of roughened material such as the cleaning element 34 of FIG. 5.

Figure 10:
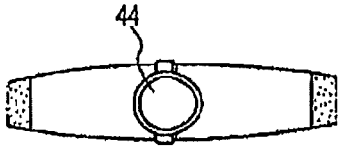

FIG. 10 shows another variation wherein the toothbrush is particularly adapted for use by children. Such use is enhanced by providing any suitable ornament or caricature 44 on the toothbrush, such as on the handle or on any other suitable location including the backside of the head. Such ornament 44 could be detachably mounted so that it could be kept by the child after the rest of the toothbrush is thrown away. Other embodiments particularly suitable for use by children include the optional capabilities of dispensing various types of oral care materials including materials having special flavors, tooth numbing materials, anti-sensitive materials or various medicaments.

The toothbrush may also be made of various colors for different parts of the toothbrush. For example, soft elastomer 18 may be made of a different, such as a contrasting, color with respect to the remainder of handle 14 which would be made of a rigid material. Similarly, the head 12 could be made of a different color than the rigid portion of the handle and/or the soft elastomer portions 18. The cleaning elements 26 could be made of distinct colors. Along the same lines the accessory 16/42 such as the toothpick or other accessory could be made of a distinct color. These various colors could be contrasting or complementary with each other. Thus, for example, the various colors could differ only slightly in color or shade.

Any suitable oral care products could be dispensed from the dispenser. Such products include, but are not limited to toothpaste, tooth powder or could be a small vial of mouthwash having a gel, a powder or a liquid. Such a dispenser could be separately included in a package containing the toothbrush 10. The materials could be flavored and could be provided in sets of different flavors and/or different characteristics such as medicaments, numbing materials, etc.

Any suitable methods may be used for forming the toothbrush 10 and its various components. For example, multi-component injection molding could be used to integrally couple various components such as the cleaning elements 26 and the head 12 and/or the handle 14. This could be done in an automated or multiple step process. The handle 14 could be rotocast blow molded to form a hollow squeeze handle.

Figure 11:
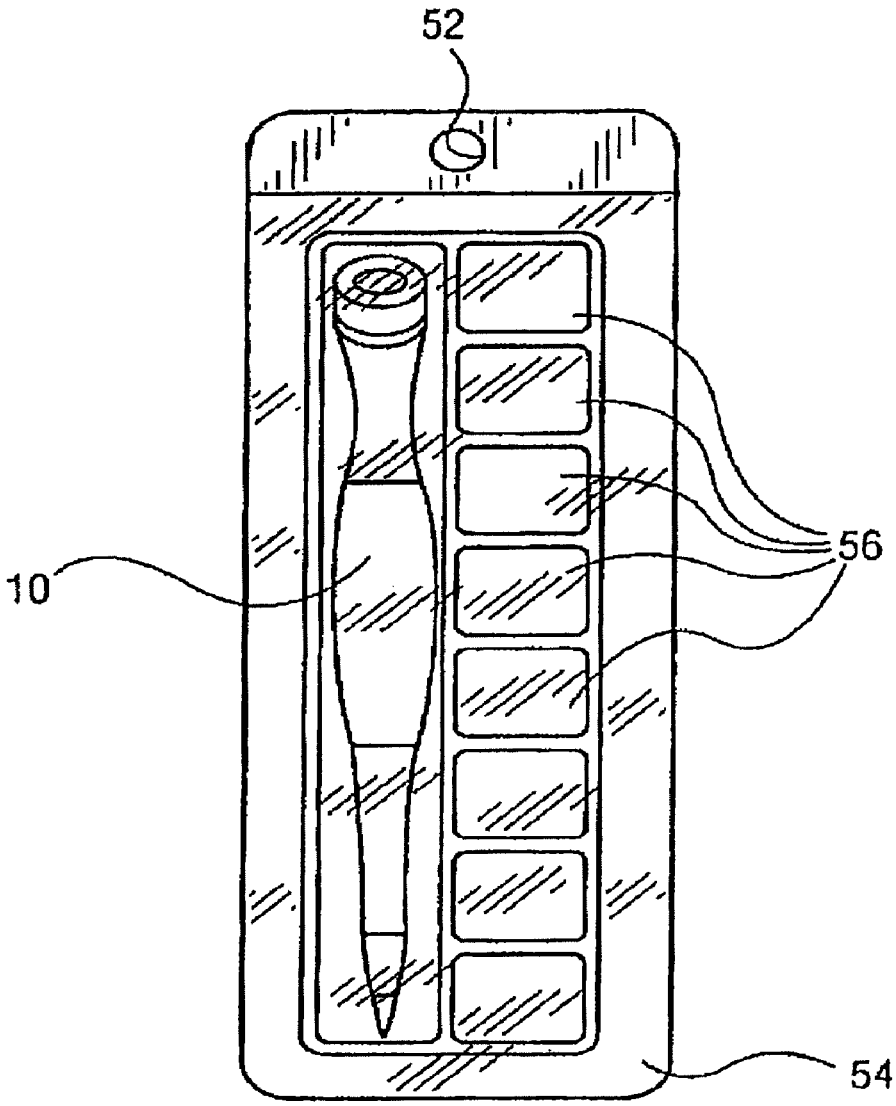
FIG. 11 is a front elevational view showing toothbrushes in a packaged or display condition.

FIG. 11 illustrates a variation wherein the package 54 includes one or more toothbrushes 10 and a plurality of other components 56 which could be accessories or dispensers or other components. The components could include a small vial of mouthwash. Preferably, the package 50 or 54 would be hermetically sealed to assure freshness.

As is apparent the features herein provide an oral care toothbrush that may be small in size and portable and can be conveniently used away from home under circumstances, such as travel, where water is not readily available.

The features herein could be practiced with a combination of various components that do not involve "toothbrush" usage. In that sense these features may be used in any oral care device or the like, rather than strictly being a toothbrush. Where used as a toothbrush or the like, the features herein may have the advantages, because of the size and configuration, to allow discreet hygienic use, such as no fingers in the mouth, adapting it to be readily used in public areas.

Figure 12:
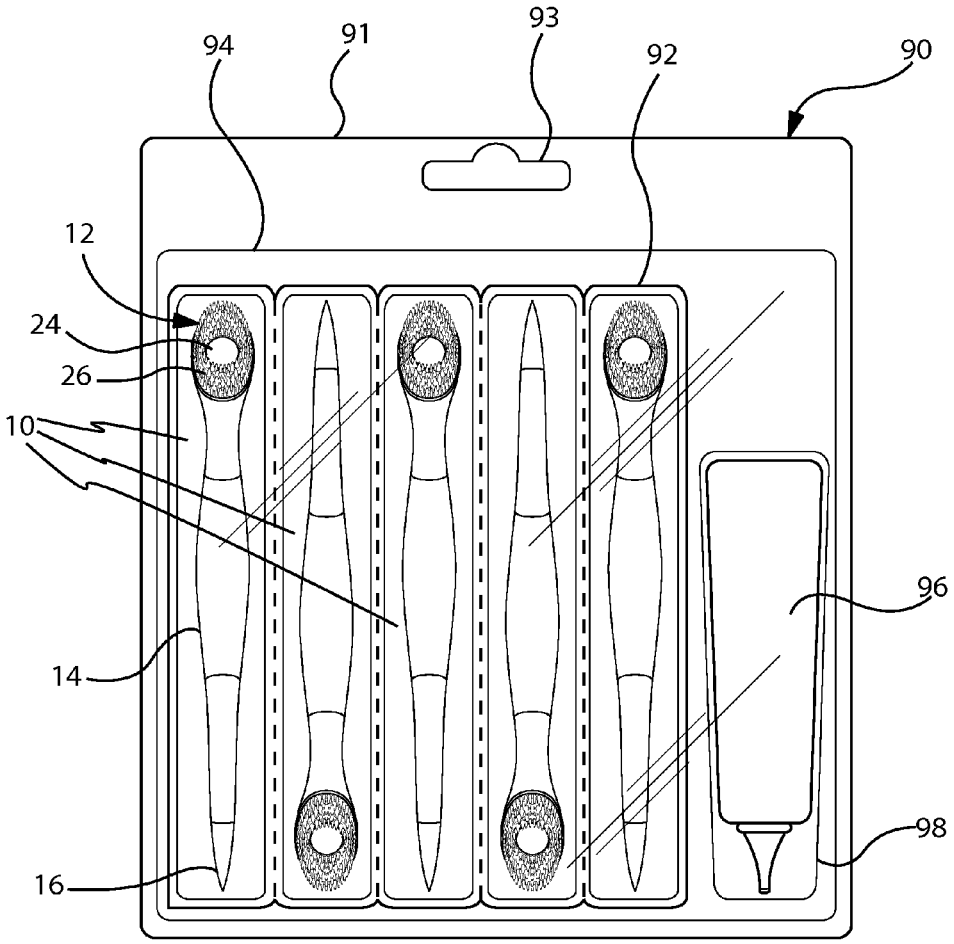
FIG. 12 is a front view of an oral care kit including a plurality of oral care implements.

FIGS. 12-16 show an embodiment of an oral care kit 90. FIG. 12 shows an oral care kit 90 comprising a plurality of oral care implements 10, and at least one dispenser 96 separate from the oral care implements 10. The oral care implements 10 may be any of the embodiments shown in FIGS. 1-10, for example. Each oral care implement 10 is a disposable toothbrush comprising a handle 14 having a head 12 at one end of the handle. In some embodiments, the head has an optional depression 24 which is empty, to receive one of the oral care materials discussed above. The head 12 has at least one cleaning element 26 projecting outwards from the head, and may be configured as shown in FIG. 4. Descriptions of the handle 14, cleaning element 26, elastomer portion 18, cleaning block 22, cushioned socket 28 and opening 30 are provided above and, for brevity, are not repeated. In some embodiments, the second end of each handle 14 has an accessory 16 such as a toothpick. Other embodiments have different accessories 42 at the end of the handle 14 opposite the head 12, as described above with reference to FIGS. 9 and 10.

Referring again to FIGS. 12-16, in some embodiments, the plurality of oral care implements 10 are all identical to each other. In other embodiments, a variety of oral care implements are included. The variety of oral care implements may include two or more of the embodiments shown in FIGS. 1-10, for example. Further, each variation of the oral care implement 10 may optionally have a respective color for easy identification.

In some embodiments, the depression 24 extends only partially through the head, so as to be capable of holding an oral care material 99, such as a liquid, emulsion, paste, gel, powder or other oral care material. In some embodiments, the depression 24 is capable of holding either a liquid, emulsion, paste, gel, powder or other oral care material.

Although FIG. 4 shows an opening 30 at the center of the depression 24, other embodiments omit the opening 30. If the opening 30 is present, the opening is capable of holding additional oral care material during use.

In other embodiments, the head does not have a depression 24. If the cleaning elements 26 are bristles, then a continuous field of bristles or foam is provided across the head 12. Alternatively, the cleaning element without a depression may be a continuous field of plastic hooks or loops 34, as described above with reference to FIG. 5, or a single mass of foam, sponge or cotton 36, as described above with reference to FIG. 6. The oral care material (paste, powder, gel, liquid or the like) is placed on the cleaning element 26. In some embodiments, the cleaning element 26 is adapted to hold or absorb oral care material that is manually dispensed by a user. The oral care material that is absorbed upon being dispensed then leaches out onto the user's teeth and gums during brushing.

Figure 16:
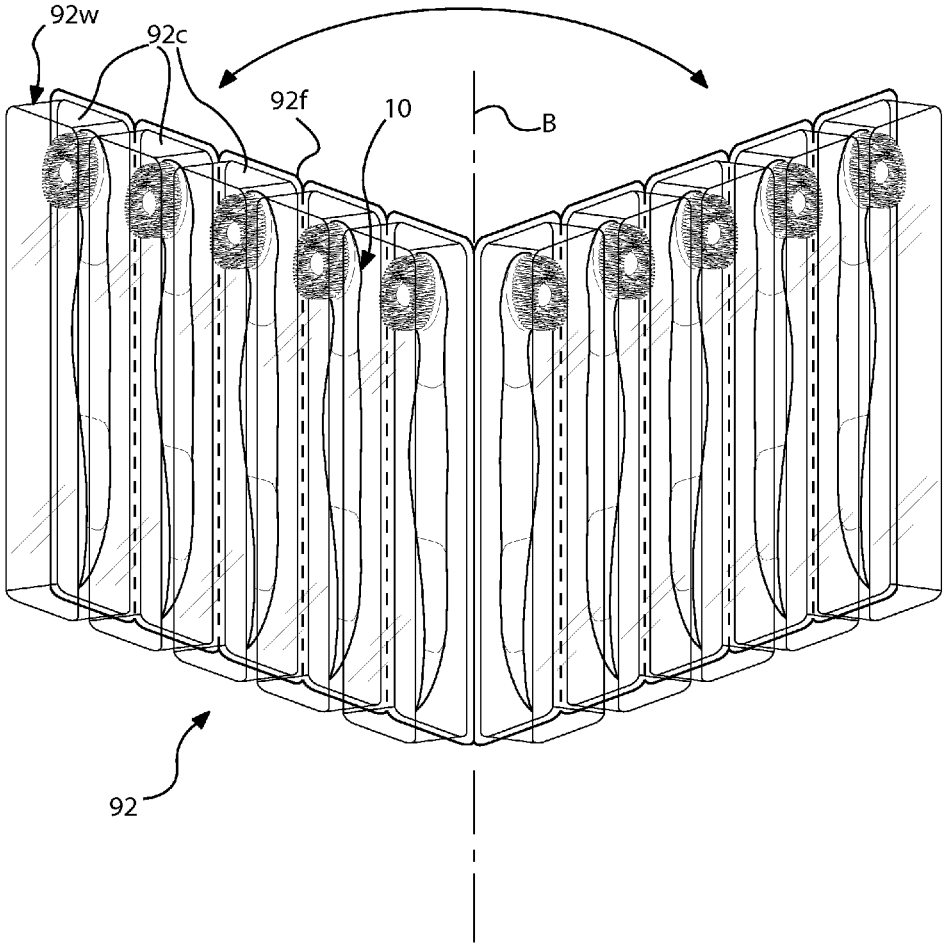
FIG. 16 is an isometric view showing the blister pack of FIG. 15 during folding.

In some embodiments, a single blister pack 92 holds the entire plurality of oral care implements 10. The single blister pack 92 may be foldable, as shown in FIG. 16, for compact storage within the kit 90. In other embodiments, the plurality of oral care implements 10 are contained within two smaller blister packs, which can be arranged back-to-back with the cleaning elements thereof facing away from each other for compact storage within the kit 90 (i.e., with the flat sides of the blister packs facing each other). In alternative embodiments, the kit 90 includes more than two blister packs (e.g., four blister packs, each containing two or three oral care implements 10.).

The blister pack 92 comprises a polymer web 92*w* (FIG. 16) having a plurality of cavities 92*c*, each cavity having a longitudinal axis A (FIG. 15), for containing the oral care implements 10 oriented with the handles 14 of each oral care implements aligned with the longitudinal axis of its respective cavity. In some embodiments, the cavities 92*c* of the blister pack 92 are shaped to conform to the shape of the oral care implements 10. In other embodiments, the cavities 92*c* are substantially rectangular or block shaped, to accommodate a variety of oral care implement shapes.

In some embodiments, as shown in FIG. 16, the blister pack 92 is a single blister pack foldable about an axis B aligned with the longitudinal axes A of the cavities 92*c*. Thus, a plurality of oral care instruments 10 in a single blister pack can be arranged back-to-back with the cleaning elements 26 thereof facing away from each other for compact storage within the kit 90.

In some embodiments, as shown in FIGS. 12, 13, 15 and 16, the handle 14 of each oral care implement 10 has a second end opposite the head 12 (i.e., at the location of the accessory 16 in FIGS. 12-16); and the plurality of oral care implements 10 alternate between a first orientation in which the head 12 points in a first direction (e.g., upwards) and the second end points in a second direction opposite the first direction, and a second orientation in which the head points in the second direction (e.g., downwards) and the second end points in the first direction. For an oral care implement design in which the head 12 is wider than the second end 16, alternating the orientations of successive oral care implements allows the distance between adjacent oral care implements (and the overall footprint of the blister pack 92) to be reduced.

In some embodiments, the blister pack 92 has a respective separable connector (e.g., perforation 92*p*) between each pair of adjacent oral care implements 10. The separable connectors 92*p* facilitate folding of the blister pack, or separation of one or more of the oral care implements 10 from the blister pack 92.

In some embodiments, the blister pack 92 is formed by a form-fill-seal process. The blister pack 92 is formed from rolls of transparent flat sheet or film using a thermoforming process. In some embodiments, the sheet or film comprises polyvinyl chloride. In other embodiments, the sheet or film comprises polyvinylidene chloride, polychlorotrifluoro ethylene, or cyclic olefin copolymer. The oral care implements are positioned on the sheet or film, and the blister pack 92 is closed (sealed) on a blisterline. The blister pack 92 includes a formed base web 92*w* defining the cavities 92*c* inside which the oral care implements 10 fit. The blister pack 92 further includes a backing card or lidding foil 92*f* (FIG. 16) for containing the oral care implements within the pack 92. A thermoplastic adhesive bonds the web 92*w* to the backing card or lidding foil 92*f*.

Figure 13:
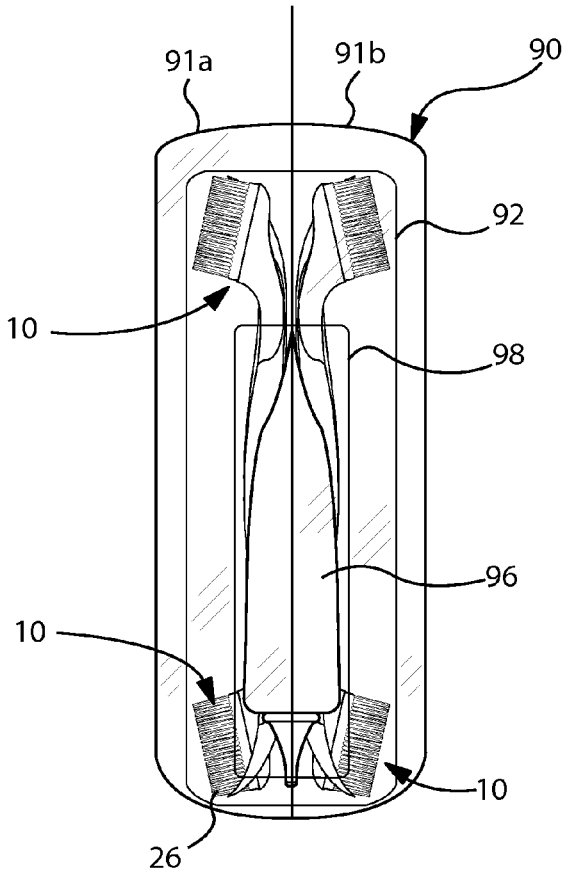
FIG. 13 is a side edge view of the oral care kit of FIG. 12.

The kit 90 includes at least one dispenser 96. Any number of dispensers 96 may be provided. For example, as shown in FIG. 12, a single relatively large dispenser 96 may be provided with sufficient oral care material for single or multiple uses of every oral care implement 10. Alternatively, as discussed below with reference to FIGS. 17-20B, a respective individual dispenser may be provided for each respective oral care implement. Although the dispenser 96 of FIGS. 12-14 is a tube, other embodiments include different dispenser types, such as a bottle, pump, can, box, sachet or other vessel. The type of dispenser 96 is selected based on the type of oral care material, in addition to such factors as convenience and cost. In some embodiments, the dispenser 96 has a narrow nozzle 96*n*, as shown in FIG. 14, to deliver a small stream or quantity of the oral care material 99 into the depression 24.

Figure 14A:
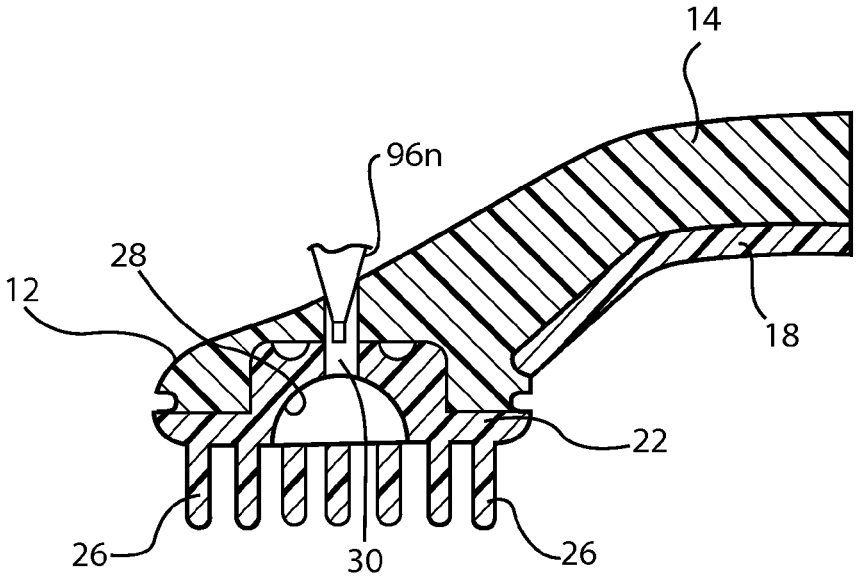
FIGS. 14A and 14B show variations of the nozzle configuration.

In an alternative embodiment shown in FIG. 14A, the opening 30 extends completely through to the back surface of head 12. The shape of the opening 30 at the rear of head 12 is coordinated to mate with the nozzle 96*n* of a separate dispenser 96 (e.g., a pump, vial, tube or the like) supplying the oral care material, so that the nozzle can be joined to the head for supplying oral care material from the rear of the head without leakage. For example, the opening 30 may be threaded with mating holes on the nozzle, or the opening and nozzle may have matching tapers. If the head 12 is provided without a depression 24, the oral care material can travel through the cleaning element(s) 26 (e.g., bristles), instead of lying on top of the bristles.

In the configuration shown in FIG. 14A, the oral care material is dispensed from a nozzle behind the head 12 into the spaces between the bristles 26. In another embodiment (not shown), the bristles are hollow, and the head includes channels to distribute the oral care material from behind the head through the channels and into the hollows with the bristles. In this embodiment, the bristles comprise a permeable material that transmits the oral care material to be desorbed onto the surfaces of the teeth during brushing.

In another variation (not shown), the cleaning element is a single mass of sponge, cotton or foam having an outer shape as shown in FIG. 6, and a hollow interior for receiving the oral care material through an opening in the back of the head. The oral care material is dispensed into the hollow through the opening in the back of the head. Then, during brushing, the oral care material is release through the material of the cleaning element.

Figure 14B:
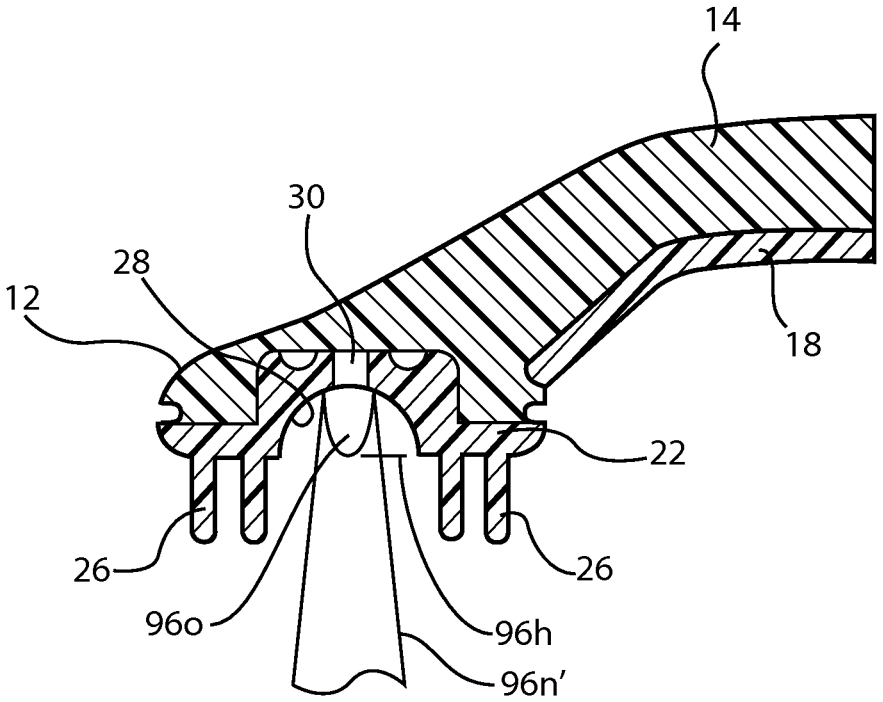
Figure 14C:
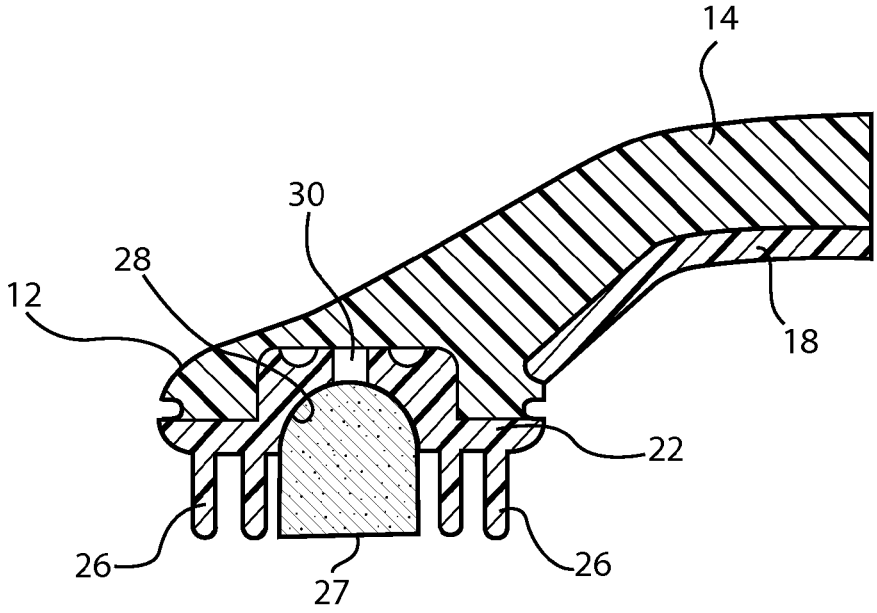
FIG. 14C shows a head having an absorbent insert.
Figure 15:
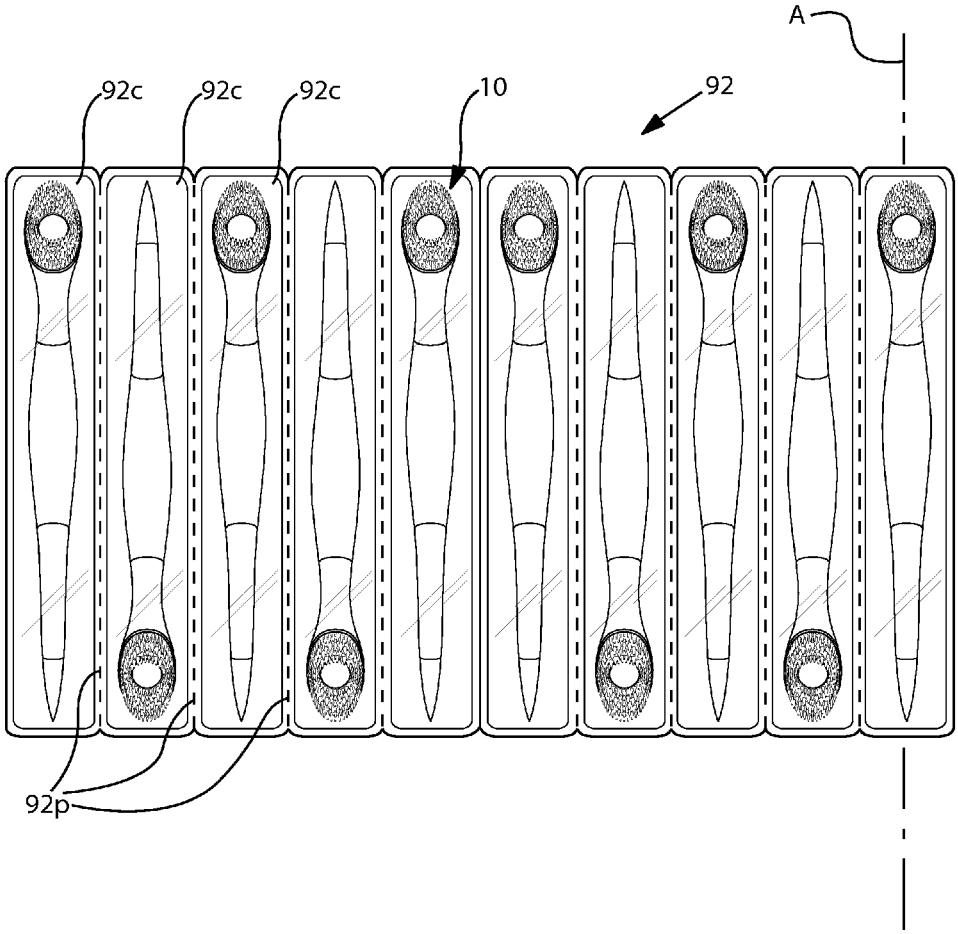
FIG. 15 is a front view of the blister pack of FIG. 12, unfolded.

In another embodiment, shown in FIG. 14B, each oral care implement has a recess or depression 28 for receiving and holding the oral care material 99, and a width of the dispensing nozzle 96*n*' is less than or equal to a width of the recess. The nozzle 96*n*' optionally has at least one side opening 96*o* coupled to receive and dispense the oral care material 99, while the tip of the nozzle 96*n*' contacts the bottom of the recess or depression 28. Thus, the tip of nozzle 96*n*' can be seated firmly against the bottom of the depression without blocking or interfering with the dispensing of the oral care material 99.

In some embodiments, the height 96*h* of the opening 96*o* (the distance from the tip of the nozzle to the shoulder of opening 96*o*) is approximately equal to the depth of the depression 28, to facilitate filling of the depression while the tip of the nozzle 96*n*' is seated against the bottom of the depression 28. This also provides a visual aid to assist the user in determining when the depression 28 has been completely filled.

In other embodiments, the height 96*h* and shape of the opening 96*o* can be selected so that the opening 96*o* engages a feature of the head 12 (such as the cleaning element 26) and acts as a depth gauge for positioning the tip of the nozzle 96*n*' at a pre-determined distance from the bottom of the depression 28. This ensures that the tip of the nozzle 96*n*' is clear for dispensing the oral care material.

The dispenser 96 contains an amount of the oral care material 99. In some embodiments, the oral care material 99 is a breath freshening solution, a toothpaste or polish, mouthwash, a fluoride rinse, or the like. In other embodiments, the oral care material may be a marker material for providing an indication of a gum disease or cancer, or a marker for tooth areas in need of additional cleaning. In some embodiments, the oral care material includes timed release materials, for releasing an active ingredient or a foaming agent. Timed release active ingredients may be used, for example, in a waterless setting, where the user keeps the oral care material in the user's mouth after brushing has ceased.

In some embodiments, where the oral care material has a relatively low viscosity, a cleaning element such as the absorbent mass of sponge, foam or cotton 36 of FIG. 6 advantageously can act as an absorbent receptacle, and prevent the oral care material from spilling if the user is not holding the toothbrush 10 with the head 12 in a perfectly horizontal orientation. Thus, the user can have one or two free hands to replace a cap on the oral care material dispenser 96, for example. Once the cleaning element 36 is placed in the user's mouth, the brushing motion releases the oral care material from the absorbent receptacle of the cleaning element 36.

In some embodiments, as shown in 14C, an absorbent receptacle 27 is provided as an insert in a toothbrush 10 having cleaning elements 26, such as bristles. The absorbent receptacle 27 may be a mass of any of the materials discussed above with reference to the cleaning element 36 of FIG. 6, including cotton, sponge, or a foam, such as a melamine foam, a foam-like material comprising a formaldehyde-melamine-sodium bisulfite copolymer. This provides the combined benefit of bristles 26, which can extend into crevices, and a soft, absorbent insert 27 that dispenses oral care material and polishes the tooth surface with its mild abrasive properties. As in the case of the single mass cleaning element 36, the absorbent insert 27 can prevent the oral care material from spilling if the user is not holding the toothbrush 10 with the head 12 in a perfectly horizontal orientation, and free up one or both of the user's hands. Once the cleaning element 27 is placed in the user's mouth, the brushing motion releases the oral care material from the absorbent receptacle of the cleaning element 36.

In some embodiments, the plurality of oral care implements 10 includes a number of oral care implements, and the amount of oral care material in the dispenser contains a number of dosages of the oral care material that is greater than or equal to the number of oral care implements. For example, in FIGS. 12-15, the kit 90 has ten oral care implements 10, and the tube of oral care material 96 has at least ten dosages of the oral care material. This amount is sufficient to at least dispense a dosage of the oral care material 99 into the respective depression 24 of each oral care implement 10 (or onto the cleaning element 26, if there is no depression) once, for usage as a single-use toothbrush. Optionally, the tube 96 may include a larger amount of oral care material (e.g., 20 or 30 dosages).

In some embodiments (not shown), the kit includes two or more dispensers 96, optionally each having a different formulation, flavor or color of oral care material 99. This allows the user to individually select the formulation, flavor and/or color of the oral care material 99 used with each oral care implement 10.

Figure 17:
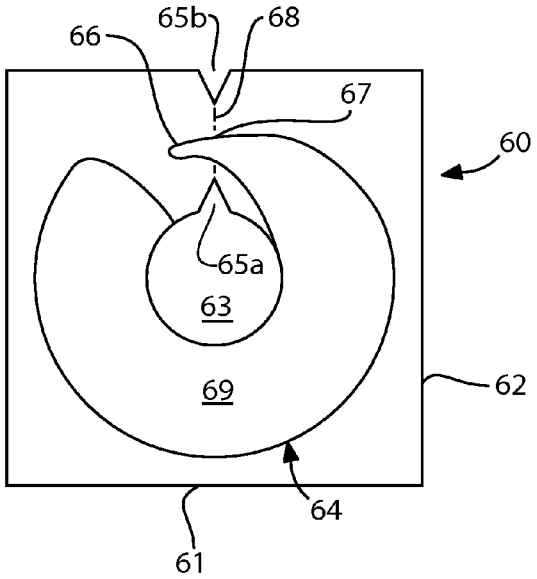
FIG. 17 is a plan view of a ring shaped sachet for dispensing oral care material.
Figure 18A:
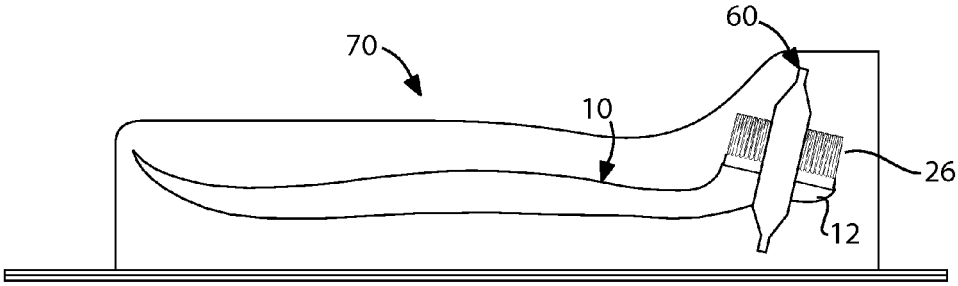
FIG. 18A is a side elevation view of a blister package containing a toothbrush with the sachet of FIG. 17 mounted thereon.
Figure 18B:
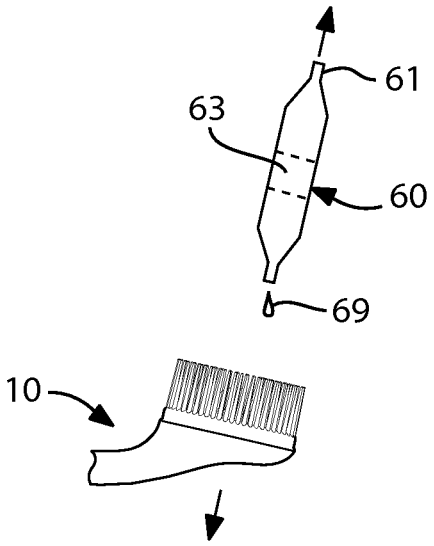
FIG. 18B shows the step of opening the sachet of FIG. 18A.

FIGS. 17, 18A and 18B show an alternative dispenser and package configuration 70. In some embodiments, the oral care material dispenser 60 is provided in the form of one or more sachets. The sachet 60 may contain a single dose of oral care material 69, or a larger amount (e.g., up to three doses). The sachets 60 are formed of a thin, flexible polymer film, and each sachet has a slit, notch or perforation 68, providing a means for manually tearing the sachet. Each sachet has a nozzle portion 67 located and shaped to form a dispensing nozzle when the slit, notch or perforation is torn.

The sachet may be generally ring shaped, with a reservoir 64, for holding the oral care material 69. The reservoir 64 surrounds a center opening 63, and includes an end 66 having a reduced width. The sachet 60 may be configured with a weakened portion 65*a* near the reduced width end 66 of the reservoir 64. In the embodiment as shown, the weakened portion 65*a* may be a notch or a slit. The notch or slit 65*a* forms a frangible seal extending in a generally radial direction, configured to be torn off to form a nozzle portion 67 for dispensing the oral care material 69 from the sachet 60. In some embodiments, the weakened portion 65*a* may be one or more perforations. Optionally, perforations 68 may be provided on either or both sides of the nozzle portion 67 to assist in tearing open the dispenser 60.

In some embodiments, the ring shaped reservoir 69 subtends an angle of 270-330 degrees around the central opening 63 of the sachet. In some embodiments, the ring shaped reservoir 69 subtends an angle of 300-330 degrees around the central opening 63.

The sachet 60 may be formed using materials and methods described in any of U.S. Pat. Nos. 4,705,680; 4,728,508; 4,770,324; 5,041,279; or 5,096,698, or International Application Publication No. WO 95/01921, each of which is incorporated by reference herein in its entirety. Other sachet fabrication methods may be used.

In some embodiments, the toothbrush 10 is used as a tool for opening the sachet 60, as shown in FIG. 18B. The center opening 63 of sachet 60 is placed around the head 12 of the toothbrush 10 during packaging, so that the head 12 of toothbrush 10 is within the sachet 60. When a user is ready to use the toothbrush 10, he/she pulls the brush 10 out of the sachet 60. In some embodiments, the user uses one hand to grasp the sachet 60 by the end 61 opposite the frangible seal 37, and uses the other hand to grasp toothbrush head 12. The toothbrush 12 is pulled in the direction of the weakened portion 65*a* (away from end 61), and is used to tear the frangible seal 67 of the sachet 60, so that when the toothbrush 10 is removed from the sachet, the dispensing orifice 67 of the sachet is opened for dispensing the oral care material 69. FIG. 18A shows a package 70 in which the sachet 60 is positioned on the head 12 of the toothbrush 10 during packaging, to facilitate the step of opening the sachet using the toothbrush 10 as a tool, upon removal of the toothbrush and sachet from the package 70.

In other embodiments, the opening of the sachet 60 (by severing the frangible seal 67) is performed in a separate step from the step of pulling the sachet off of the toothbrush 10. The toothbrush 10 is moved along its longitudinal axis, without tearing the frangible seal 67. Then the seal 67 is broken by tearing open the sachet 60 along the notch 65*a* and/or perforations 68. Optionally, a second weakened portion 65*b* may be provided along the outer edge of the sachet 60 to facilitate manual tearing of the frangible seal without using the toothbrush 10 or any other tool to perform the tearing. Similarly, the second weakened portion 65*b* may be a notch, a slit, or one or more perforations.

In some embodiments, the sachet 60 is a separate package, which is individually placed within a blister pack or bag that houses the toothbrush 10. For example, a blister pack may have two rows and ten columns of chambers. The chambers in one row contain toothbrushes 10. The chambers in the other row contain sachets 60. Each column has a respective toothbrush and a respective sachet 60. The two rows have a separable connector therebetween. The separable connector is one of the group consisting of a perforated region of the package, a region of the package having a cut or notch, a film or tape of a material that is susceptible to tearing or rupturing, or at least one adhesive joint connecting separately formed sections of the package. Another separable connector is provided between each successive pair of adjacent columns. Thus, a user can easily manually separate one column from the blister pack to form an individual kit (a "sub-kit") having one toothbrush 10 and one dispenser 60. Similarly, a user about to embark on a trip can tear off a portion including N columns (N toothbrushes and N sachets, where N is an integer) as desired.

In other embodiments, a plurality of sachets 60 are formed along a continuous sheet of plastic, with separable connectors (e.g., perforations, slits or the like) between each adjacent sachet 60. The strip of sachets 60 can be separate from (i.e., unconnected to) the blister package of toothbrushes 10.

Figure 19A:
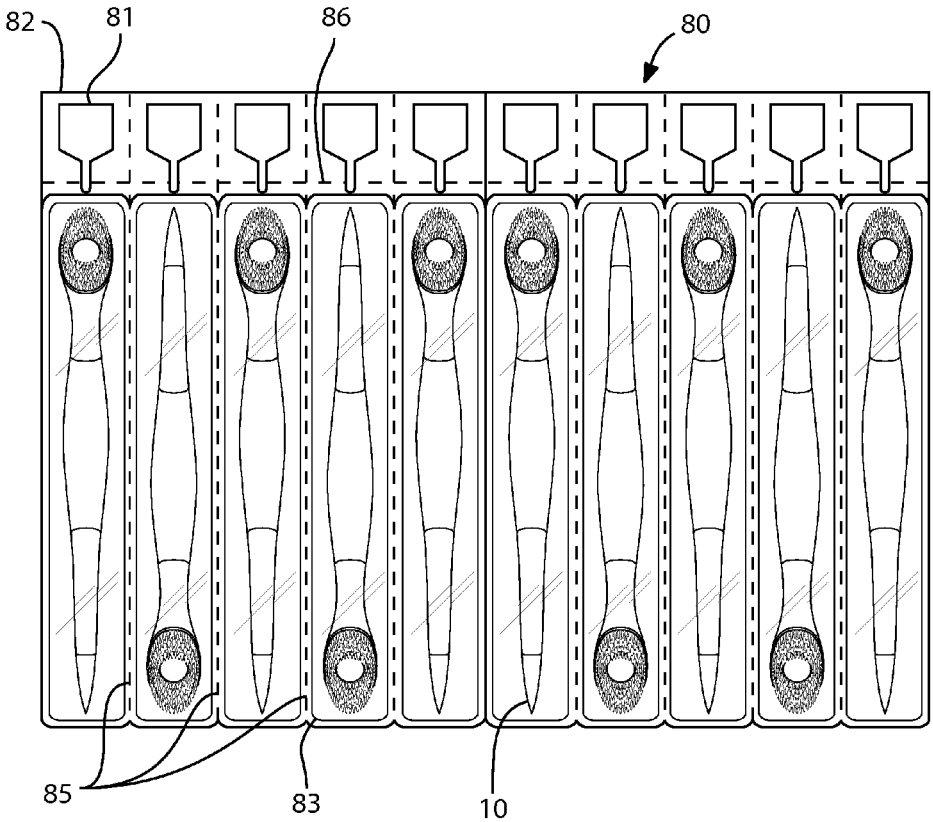
FIG. 19A is a plan view of an alternative blister pack design.

FIG. 19A shows another embodiment, in which the plurality of oral care implements 10 are packaged within a first package, such as one or more blister packs 80, and the sachets 81 are formed as part of the same blister pack 80. Blister pack 80 has two rows and ten columns of chambers, but any number of columns may be used. The chambers 83 in one row contain toothbrushes 10. The chambers 82 in the other row contain sachets 81. Each column has a respective toothbrush 10 and a respective sachet 81. The two rows have a separable connector (e.g., perforations) 86 therebetween. Another separable connector (e.g., perforation) 85 is provided between each successive pair of adjacent columns. Thus, a user can easily manually separate N column(s) from the blister pack 80 to form an individual kit (a "sub-kit") having N toothbrush (es) 10 and N dispenser(s) 81, where N is an integer from one to C−1, where C is the total number of columns in blister package 80.

Figure 19B:
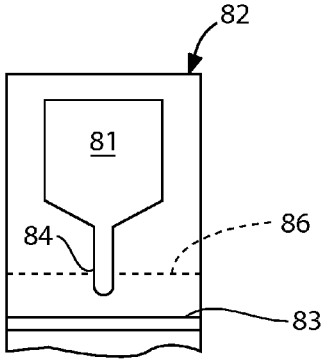
FIG. 19B is an enlarged detail of the sachet of FIG. 19A.

FIG. 19B is an enlarged detail of a chamber 82 containing one sachet 86. In this example, the sachets 81 are formed from the same polymer film sheet used to form the blister package 80, and the same separable connectors 86 that separate the toothbrush chamber 83 from the sachet chamber 82 also provide a means for tearing open the nozzle 84 of the sachets 81. Thus, a single perforation line 86 can be formed between the row of sachet chambers 82 and the row of toothbrush chambers 83. (The perforations are interrupted at each nozzle section 87 of each sachet 81, to avoid leakage of the oral care material). In a single motion, the user can separate one of the sachet chambers 82 from its associated toothbrush chamber 83, and also open the nozzle 84 of the sachet 81 of that chamber 82. The act of tearing the perforation 86 forms the open dispensing nozzle of the sachet 81.

The reservoir for containing the oral care material in in each sachet 81 is approximately pentagonal, with a narrow portion for forming the nozzle 84. However, the reservoir can be any convenient shape, such as, but not limited to rectangle, square, trapezoid, circle, ellipse, oval, or the like.

One of ordinary skill understands that the designation of horizontal rows and vertical columns herein is optional, and the same package may be rotated 90 degrees, in which case the rows are vertical and the columns are horizontal.

Figure 20A:
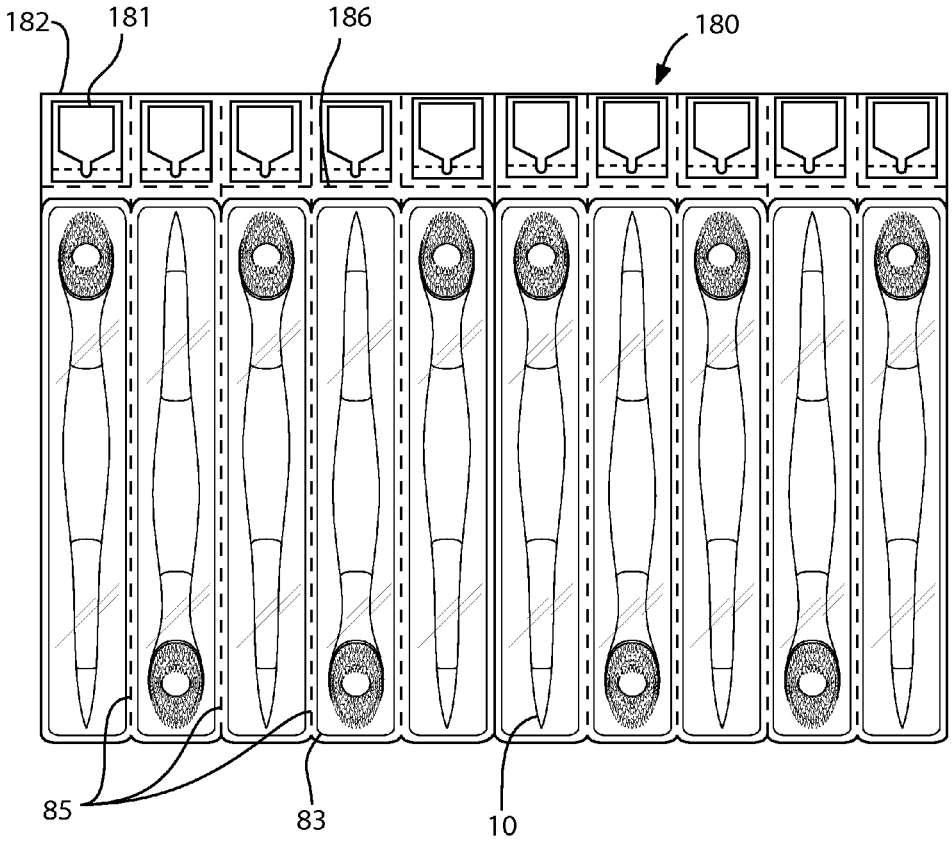
FIG. 20A is a plan view of a variation of the blister pack of FIG. 19A.
Figure 20B:
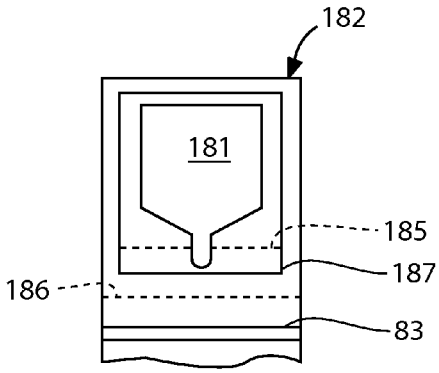
FIG. 20B is an enlarged detail of the sachet of FIG. 20A.

FIGS. 20A and 20B show a variation of the package of FIGS. 19A and 19B, in which each sachet 187 is formed separately from the film that forms the sachet chamber 182 of the blister pack 182. The sachet 187 can optionally be removed from its chamber 182 without severing the separable connector 186 which separates the sachet chamber 182 from its respective toothbrush chamber 83. Similarly, once removed, the sachet 187 can be returned to its chamber 182, either for disposal after a single use, or for a second usage, if the reservoir 181 of sachet 187 contains more than one dosage of oral care material. The sachet chamber 182 can optionally be separated from its respective toothbrush chamber 83 by tearing the blister pack material along the perforated line 186. Each sachet 187 has a distinct separable connector 185 (e.g., a weakened portion such as a perforation, slit or notch) for tearing the film of the sachet 187 to open the nozzle orifice of the sachet, for dispensing the oral care material.

In other respects, the layout and construction of kit 180 is similar to that of kit 80 (FIGS. 19A and 19B), and a description thereof is not repeated.

Referring again to FIGS. 12, 13, 15 and 16, the oral care kit 90 may optionally include an outer package, such as a clamshell container 91. An outer package may be included for protection of sachets and or other accessories, and to prevent their accidental separation from the remainder of the kit 90. An outer package 91 may also be used for storing a separate oral care material dispenser, such as a tube 96, pump, can or the like. An outer package may also provide contoured compartments for holding either the toothbrush 10 or dispenser 96 during a dispensing or brushing operation.

In some embodiments, the outer package 91 includes either two pre-formed plastic sheets or one sheet folded over onto itself and fused at the edges. The sheet(s) comprise a transparent polymer that is durable and more rigid than the blister pack web 92*w*, either by choice of material or by the thickness of the polymer material.

The outer package 91 includes at least one transparent shell 91 having a first opening 94 shaped to contain the plurality of oral care implements 10, and a second opening 98 shaped to contain the dispenser 96. The second opening 98 is separate from the first opening 94.

In some embodiments, a clamshell package 91 has two symmetrical halves 91*a*, 91*b* (shown in FIG. 13), each half shaped to receive a blister pack 92 or a portion of a blister pack, containing a subset of the plurality of oral care implements 10. Each half 91*a*, 91*b* is shaped to receive a respective portion of the dispenser 96.

In some embodiments, each half 91*a*, 91*b* is shaped to receive at least a portion of the at least one blister pack 92, containing a subset of the plurality of oral care implements 10. In some embodiments, the clamshell package 91 has two halves 91*a*, 91*b*, each half shaped to receive a respective portion of the web 92*w* of the blister pack 92, as shown in FIG. 13. Each half 91*a*, 91*b* is shaped to receive a respective portion of the dispenser 96. In some embodiments having a single blister pack 92 folded about an axis B (shown in FIG. 16), each half of the folded blister pack is received by a respective half of the clamshell 91, as shown in FIG. 13.

In some embodiments, the outer package 91 has a slot 93 for hanging the kit 90 from a store rack or hook. Optionally, a larger slot (not shown) may be provided for use as a handle.

In other embodiments, the two portions of the clamshell 91 are not mirror images of each other, but include a first side with deeper recesses, and a second side with shallower (or no) recesses. Other variations of the clamshell 91 can accommodate variations in the shape and configuration of the blister-pack(s) 92 and the dispenser(s) 96.

An example of a method of fabricating the kit 90 includes providing at least one blister pack containing a plurality of oral care implements, and folding the at least one blister pack 92 about its axis B, so that two portions of the web 92*w* face in opposite directions. The at least one blister pack 92 is inserted into a clamshell package 91; and at least one dispenser (e.g, a tube 96 having a nozzle 96*n*) is inserted into the clamshell. The dispenser 96 is separate from the blister pack 92 and contains an amount of the oral care material 99. The clamshell package 91 has a first opening 94 shaped to receive the at least one blister pack 92 and a second opening 98 shaped to receive the dispenser 96. The clamshell package 91 is then sealed with the at least one blister pack 92 and the dispenser 96 therein.

In some embodiments, the blister pack has a first edge and a second edge, and the providing step includes arranging the plurality of oral care implements in respective cavities, so that successive oral care implements alternate between: a first orientation in which the head of the oral care implement is adjacent the first edge and the second end thereof is adjacent the second edge, and a second orientation in which the second end of the oral care implement is adjacent the first edge and the head thereof is adjacent the second edge. In some embodiments, a respective perforation 92*p* is made in the blister pack 92 between each pair of adjacent oral care implements 10.

In some embodiments, a method of using the oral care kit 90 comprises opening a clamshell package 91 and removing a blister pack 92 from the clamshell package. The blister pack 92 includes a plurality of cavities 92*c* containing respective oral care implements 10. Each oral care implement 10 comprises a handle 14 having a head 12 at a first end of the handle, the head having at least one cleaning element 26 projecting outwards from the head, the head having at least one concave depression 24 shaped to hold an oral care material.

The user removes one of the oral care implements 10 from the blister pack 92. The user removes a dispenser 96 from the clamshell package 91. The dispenser 96 is separate from the oral care implements 10. The user dispenses a dose of the oral care material 99 from the dispenser 96 into the depression 24 of the removed oral care implement 10. The user uses the removed oral care implement with the oral care material 99 on it to perform a dental care procedure, such as brushing the user's teeth.

In some embodiments, the user disposes of the removed oral care implement 10 after a single usage. In some embodiments, the user repeats (for each oral care implement 10) the steps of removing an oral care implement from the package 92, dispensing the oral care material 99 onto the removed oral care implement, performing the dental care operation and disposing of the removed oral care implement after use.

In some embodiments (not shown), the kit 90 includes at least two variations of the oral care implement and at least two dispensers containing respectively different oral care materials. The user coordinates the selection of one of the oral care implements with the selection of oral care material. In some embodiments, the handles 14 and dispensers 96 are optionally color coded to indicate suggested pairings of differentiated oral care implements 10 with respective differentiated oral care materials 99. For example, in some embodiments, the oral care implements have a respectively different handle color for each cleaning element type or for accessory type, and the dispenser containing the corresponding recommended oral care material for each oral care implement type has the same color.

Other embodiments will be apparent to those skilled in the art from consideration of the specification disclosed herein. It is intended that the specification and examples be considered as exemplary only, with the true scope and spirit of the invention being indicated by the following claims and their range of equivalents.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. An oral care kit, comprising:

a sachet having a ring shaped reservoir for an oral care material configured around a central opening, the sachet having a first weakened portion for forming a dispensing nozzle, and an oral care implement sized so that a portion of the oral care implement fits through the central opening, the oral care implement configured to be used to tear the first weakened portion of the reservoir.

2. The oral care kit of claim 1, wherein the first weakened portion is a notch, lit, or perforation.

3. The oral care kit of claim 1, further comprising a package, wherein the sachet is arranged around the oral care implement within the package, so that the oral care implement extends through the central opening.

4. The oral care kit of claim 3, wherein the oral care implement includes a head that extends through the central opening.

5. The oral care kit of claim 1, wherein first weakened portion of the ring shaped reservoir has a reduced width, for forming a nozzle when the first weakened portion is torn.

6. The oral care kit of claim 1, wherein the ring shaped reservoir subtends an angle of 270 degrees to 330 degrees around the central opening.

7. The oral care kit of claim 1, wherein the ring shaped reservoir subtends an angle of 300 degrees to 330 degrees around the central opening.

8. The oral care kit of claim 1, wherein the sachet is formed of a polymer film.

9. The oral care kit of claim 1, wherein the polymer film comprises one of: polyvinyl chloride, polyvinylidene chloride, polychlorotrifluoro ethylene, or cyclic olefin copolymer.

10. The oral care kit of claim 1, wherein a second weakened portion is provided at an outer edge of the sachet.

* * * * *